United States Patent [19]

Pesiri

[11] 4,165,900

[45] Aug. 28, 1979

[54] RECLINABLE SEATING STRUCTURES

[75] Inventor: James B. Pesiri, Dana Point, Calif.

[73] Assignee: J. C. Sales & Mfg., Inc., Irwindale, Calif.

[21] Appl. No.: 914,489

[22] Filed: Jun. 12, 1978

Related U.S. Application Data

[63] Continuation of Ser. No. 772,634, Feb. 28, 1977, abandoned.

[51] Int. Cl.[2] ..... A47C 1/026

[52] U.S. Cl. ..... 297/369; 297/306

[58] Field of Search ..... 297/369, 368, 367, 366, 297/378, 379, 306, 354, 355, 370, 371

[56] References Cited

U.S. PATENT DOCUMENTS

| | | | |
|---|---|---|---|
| 317,295 | 5/1885 | Carter | 297/306 |
| 412,617 | 10/1889 | Hogan | 297/369 |
| 1,793,045 | 2/1931 | Bitzenburger | 297/378 X |
| 2,283,485 | 5/1942 | Beck | 297/369 X |
| 2,573,845 | 11/1951 | Hoven et al. | 297/367 |
| 3,272,555 | 9/1966 | Barecki et al. | 297/369 |

FOREIGN PATENT DOCUMENTS

| | | | |
|---|---|---|---|
| 629551 | 10/1961 | Canada | 297/379 |
| 596828 | 8/1959 | Italy | 297/367 |

*Primary Examiner*—Roy D. Frazier
*Assistant Examiner*—William E. Lyddane
*Attorney, Agent, or Firm*—Edward J. DaRin

[57] ABSTRACT

A reclinable seating structure in the form of a seating tubular frame utilizing the frame for the mechanism to allow the back supporting structure to be movable is realized. The reclining spring is housed completely within the tubular frame thereby substantially reducing the manufacturing costs.

5 Claims, 5 Drawing Figures

B
13
14
20
22
12
23
AR
BL
11
26
A
10
21
24
25
23L
15
226
BLD
5

RECLINABLE SEATING STRUCTURES

CROSS REFERENCE TO RELATED APPLICATIONS

This is a continuation of application Ser. No. 772,634, filed Feb. 28, 1977.

PRIOR ART AND SUMMARY OF THE INVENTION

This invention relates to a reclinable seating structure and more particularly to seating structure frames.

Various types of seating structures are presently available for use in the home, gardens, motor vehicles, including trucks, vans, buses and motor homes. These seating structures are generally constructed on a suitable frame and then upholstered to provide comfortable seating structures for sitting, reclining or lying down. At the present time, there is a substantial use of vans, motor homes and buses on the public highways. These motor vehicles utilize a variety of seating structures therein. With the present governmental emphasis and stress on safety features for motor vehicles, motor vehicle seating structures must comply with the federal safety regulations covering them. Seating structures that are commercially available utilize frames of various forms, constructions and configurations including the use of tubular framing structures. At the present time, tubular frame structures adaptable for use in the aforementioned types of motor vehicles are in use and meet federal safety regulations. Such tubular framing structures are constructed as both rigid, upright seating structures and structures with movable back supporting elements and may be supplied with and without arm rests. When an arm rest is provided, they are generally adapted to be moved from an arm resting position to a position out of the path of the movement of the sitter. The tubular frame structures used in motor vehicles that are presently known and commercially available and are adapted to be reclinable generally include a large, bulky structure for housing a spring or the like for permitting the back supporting structures to be positioned at an angular relationship with the seating structure proper. This type of structure has been found to be very difficult to upholster and therefore increases the overall costs of such seating structures employing this type of frame structure.

The present invention provides an improved, simple and relatively inexpensive seating structure that meets the standards set out in governmental regulations and yet eliminates the problems of the prior art structures constructed as recliners including a reduction in the cost of upholstering such seating structures. The concept of the present invention embodies a seating frame structure that is reclinable and constructed of a minimum of parts and has the general appearance of a nonreclining structure as a result of the elimination of the bulky structures used heretofore for reclining purposes and can be manufactured at a cost only slightly higher than the manufacturing costs for nonreclining structures. The cost saving is realized through the use of conventional tubular seating structures and utilizing the basic elements of the nonreclining portion thereof for housing the mechanism for permitting the back supporting structure to be reclinable with a substantial saving in cost not heretofore thought possible.

The seating structure of the present invention comprehends a reclinable seating structure, or the like, comprising a tubular structure having a preselected configuration for supporting a comfortable, seating structure and constructed and defined as a frame for supporting the seating structure. The seating structure includes a back supporting structure having a preselected configuration for supporting the back of a sitter arranged on the seating structure and constructed and defined as a back supporting structural frame that is movably secured to a tubular seating frame structure. The seating structure includes means for movably securing the back supporting frame supporting to the seating frame structure to permit the back supporting structure to be selectively moved to a multiplicity of angular positions relative to the seating frame structure including a reclining position and to be secured in one of the selected positions. The movable means includes yieldable means which may be in the form of a compression spring housed within the tubular structure comprising the seat supporting structure.

These and other features of the present invention may be more fully appreciated when considered in the light of the following specification and drawings, in which.

Figures 1, 4:
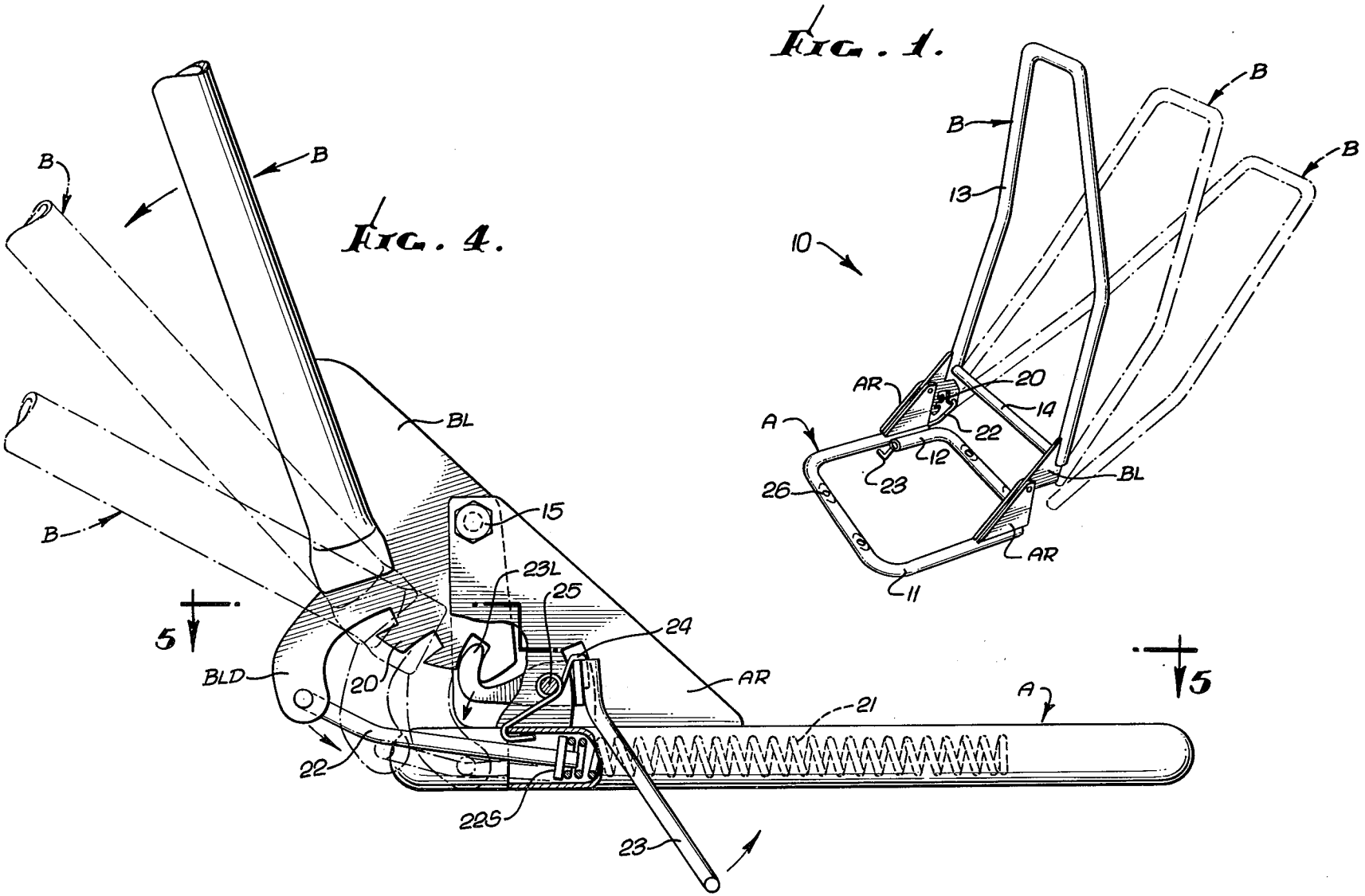
FIG. 1 is a perspective view of a reclinable seating structure embodying the present invention and with the back supporting structure shown in different inclined positions in dotted outline.
FIG. 4 is a partial, elevational view of the left-hand side of the seating structure with portions broken away and illustrated in section, and with the back supporting structure illustrated in different positions along with its coacting mechanism in dotted outline.
Figure 2:
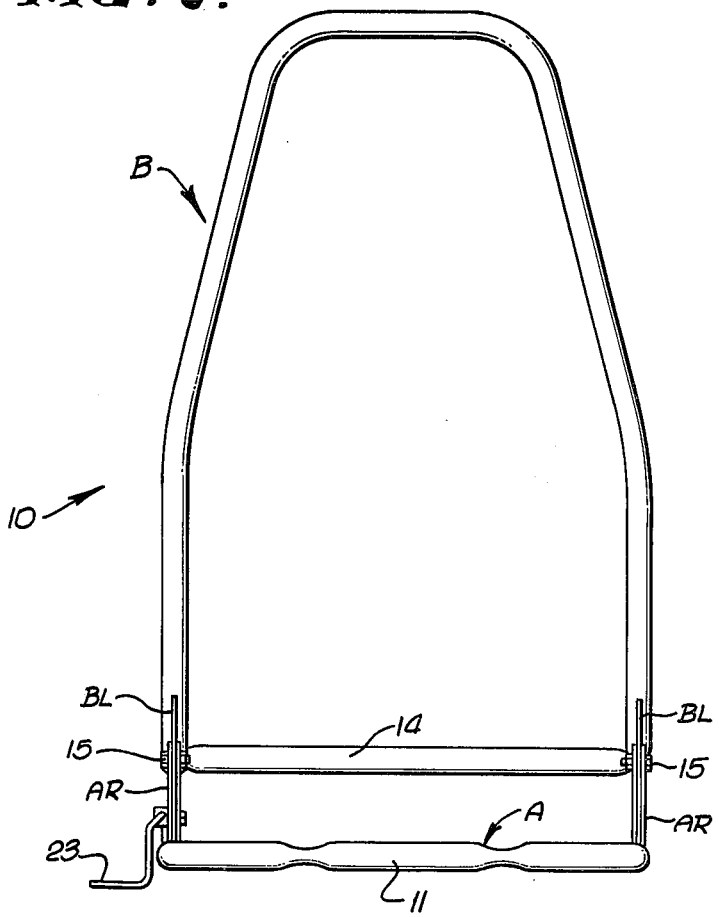
FIG. 2 is a front end, elevational view of the seating structure of FIG. 1.
Figure 3:
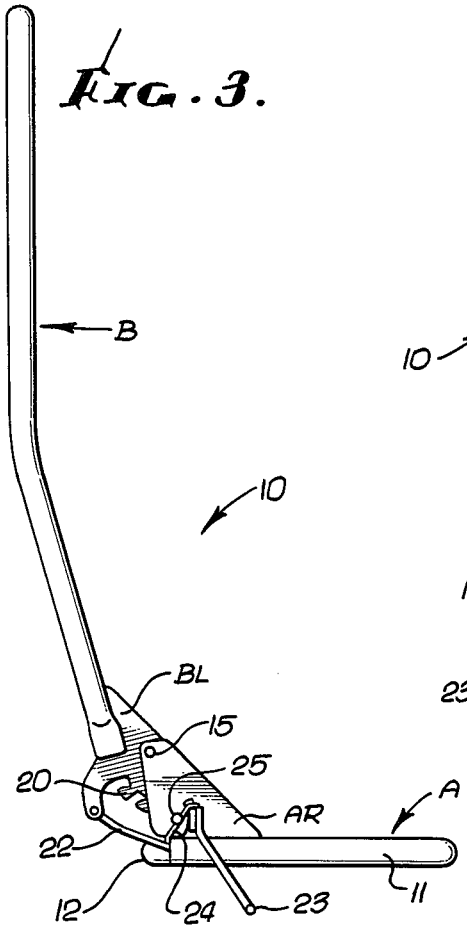
FIG. 3 is a left side elevational view of the seating structure as illustrated in FIG. 1.

Now referring to the drawings, the seating structure 10 of the present invention will be examined in detail. The seating structure 10 embodying the present invention will be described as it may be embodied in a tubular frame structure adapted for use in various types of motor vehicles although the concept is applicable to other similar types of seating structures. Basically, the seating structure 10 comprises a seating frame A and a back supporting structure B illustrated in FIG. 1 as having a high back configuration. The back supporting structure B is movably secured to the seating structure A to allow it to be positioned at a plurality of angular positions relative to the seating structure A. In its normal position the back supporting structure B is arranged upright as illustrated in FIG. 1 and may be moved from this position backwardly to various angular positions, including a reclining position as the terminal position of the back supporting structure B. The tubular structure comprising the seating structure 10 is constructed of a minimal of tubular elements throughout with each element bent and shaped to provide the desired configuration, contour and structural rigidity. The individual tubular elements utilized for the seating structure A and the back supporting structure B are welded for minimizing the assembly operations for the seating structure 10. The seating element A, for example, includes a tubular element 11 bent into a large "U" for defining the seating frame A. A second tubular element 12 bent into a smaller U-shape is secured at the open end of the U-shaped tubular element 11 to close the "U" formed by the element 11 and is welded thereto to provide a rigid seating frame A. The back supporting structure B is similarly constructed of a single tubular element 13 shaped with a high back, contoured, U-shaped configuration and having a second tubular element 14 closing the open end of the "U" formed by the tubular element 13. The tubular element 14 is a straight piece of tubing welded adjacent the open end of the U-shaped tubular frame 13.

The seat frame structure A mounts a pair of hinge plates AR adjacent the back corners of the framing structure and adjacent the tubular element 12. The hinge plates AR each consist of a pair of flat plates spaced apart a distance approximately the thickness of one of the plates AR and are illustrated as having a triangular configuration. Similarly, there is welded to the lower end of the element 13 of the back supporting structure B a single plate BL welded thereto at each lower corner thereof adjacent the tubular element 14 and extending outwardly therefrom at an approximately 90 degree angle. The plates BL are each slidably mounted between a coacting pair of plates AR and are pivotably secured thereto by a fastener 15, illustrated as a nut and bolt. With the movement to position the back supporting structure B, the plates BL slidably swing between the individual pair of plates AR to which they are secured. The left-hand plate BL for the back supporting structure 13, as viewed in FIG. 1, has a plurality of teeth or locking detents 20 constructed and defined at the lower end of the plate for coacting with the reclining control means to be described hereinafter.

Figure 5:
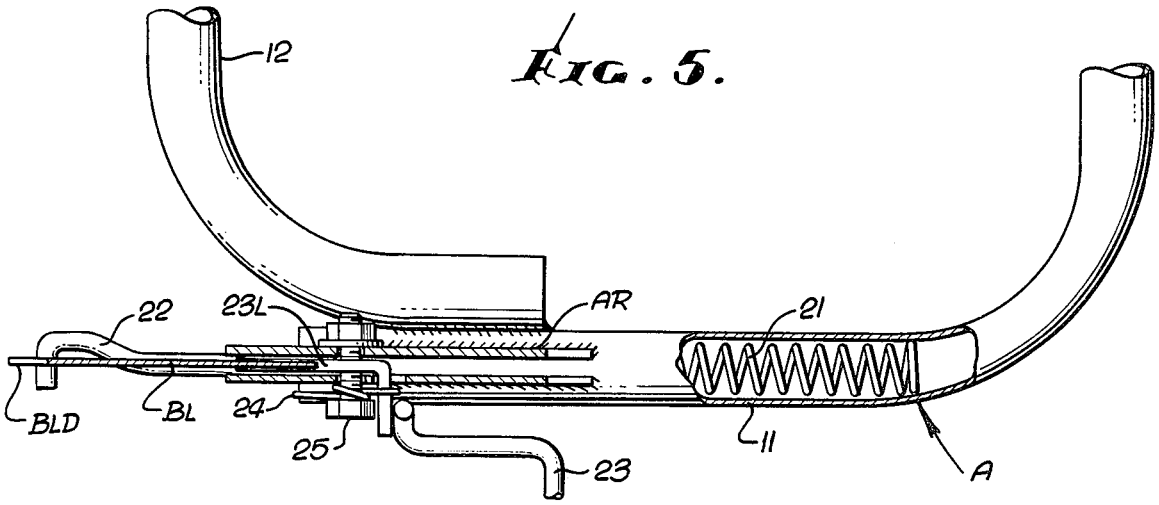
FIG. 5 is a sectional view taken along the lines 5—5 of FIG. 4 with parts broken away and illustrated in section.

The reclining control means comprises yieldable means illustrated in the form of a compression spring 21 housed within the seating strucure A proper and in particular in the open end of the tubular element 11 adjacent the left-hand side thereof as illustrated in FIG. 1; see FIGS. 4 and 5. The tubular element 11 is utilized to house the compression spring 21 and which spring is defined to be of a length corresponding to the longitudinal length of the tubular element 11 along the left side thereof. This arrangement is selected so that the inner end of the spring 21 will be seated in the section of the tubular element 11 having a reduced internal diameter as a result of being bent to form the front corner of the framing structure A, as best appreciated from examining FIG. 5.

The left-hand plate BL has a dependent section BLD with an aperture provided adjacent the lower end thereof for securing an end of a spring operating arm 22. For this purpose, the outer end of the operating arm 22 is bent into an "L" configuration and which end is secured in the aperture for the dependent portion BLD of the plate BL. The opposite end of the operating arm 22 is mounted in the open end of the tubular element 11 and carries a disc shaped element 22S adjacent the end thereof for seating the outer end of the compression spring 21. A manually operable control arm 23 extends outwardly from and adjacent the tubular element 11 at the inner end of the seating structure to allow a sitter to readily control and select a comfortable position for the back supporting structure B. For this purpose, the control arm 23 may also have an L-shape to allow it to be conveniently grasped by hand by an individual seated in the seating frame A for locking and unlocking the back supporting structure B in a comfortable position. The control arm 23 carries a latching finger 23L that extends between the pair of plates AR for locking engagement between a pair of the teeth or detents 20 defined on the plate BL. The finger 23L is pivotally controlled by the operating arm 23 to allow it to be swung into and out of engagement with the detenting structure. The operating arm 23 is secured by means of a spring wire element 24 having one end bent and secured to the open end of the tubular element 11; see FIG. 4. The element 24 is wrapped around the head of its fastener 25 and has its remaining end securing the end of the operating arm 23 in position for proper operation. In its normal at rest position the compression spring 21 is in an expanded condition with the finger 23L secured in the innermost aperture defined between the two inner teeth 20 for the plate BL and thereby maintains the back supporting structure B in an upright position. The movement of the control arm 23 in a counterclockwise direction will cause the release of the finger 23L from its secured position and allow the back supporting structure B to be moved backwardly to a comfortable position for the sitter. To this end, the various positions intermediate the upright position and the terminal reclining position are realized through the provision of a multiplicity of openings between the teeth 20 for securing the finger 23L, as is evident from examining the drawings. The various positions of the control mechanism for selectively securing the back supporting structure in the various angular relationships with respect to the seating frame A are shown in dotted outline in FIG. 4 and correspond with the successive latched positions of the finger 23L into the successive openings in the plate BL.

It should be appreciated that the control mechanism that adapts the seating frame structure so that it may be reclinable, utilizes a minimum of parts and requires a minimum of labor for construction and assembly. To this end, the basic structure of the seating frame A is utilized for housing the compression spring 21. In accordance with the present invention, the compression spring 21 may be readily dropped into the tubular element 11 until it seats itself adjacent the reduced diameter portion, or bent portion, of the element 11 without any further housing structures being required. Similarly, the hinge plates BL employed are utilized herein for defining the locking mechanism for selectively positioning the back supporting structure B as desired. This same plate BL further carries the spring operating arm 22 for selectively compressing the spring 21 in a back supporting position. The compression spring 21 has been selected to have sufficient compressive strength to support the weight of an individual resting and/or reclining against the back support B. The inward movement of the arm 22 progressively compresses the spring 22 inwardly as a result of the back support being progressively moved toward a horizontal position. Similarly, when the back supporting structure B is moved towards the upright position, the compressive force of the spring 21 is progressively released. The seating structure 10 may be constructed by means of conventional tubular structures to take advantage of the characteristics thereof to allow it to be readily converted to function as a recliner and yet meet all of the present day safety regulations for use on motor vehicles, or the like. To facilitate the assembly of seating elements, and the like, the framing element A may be prepunched with holes such as the holes 24 for securing a suitable upholstered seating structure. The housing of the spring 21 within the frame structure proper allows the frame to be readily upholstered with a minimum of expense. The all-welded construction of the seating structure 10 also minimizes the manufacturing costs in eliminating a substantial portion of the assembly time previously required.

It should now be appreciated by those skilled in the art that the present invention has provided an improved relatively inexpensive reclinable seating structure that may be easily manufactured and constructed at a cost slightly above the cost of similar seating structures that are not reclinable and has therefore advanced the state of the art.

I claim:

1. A frame for a seating structure adapted to be moved from an upright to a plurality of reclinable positions, the frame being constructed and defined for use in a motor vehicle such as a van, motor home or the like comprising a first U-shaped tubular structure having a preselected size, a second U-shaped tubular structure having a smaller size than the size of the first U-shaped tubular structure so as to be secured at the open end of the first U-shaped tubular structure to close the "U" formed by said first structure while leaving the ends of the first tubular structure open, means for securing the thus arranged first and second structures together whereby the secured arrangement is adapted for accepting and securing an upholstered seating structure.

a third U-shaped tubular structure having a preselected length for the arms of the "U", a straight tubular element secured adjacent the open end of the third tubular structure functioning as a cross-arm to close the "U" formed by the third structure, whereby the thus secured arrangement is adapted for accepting and securing an upholstered back supporting structure, compression spring means mounted and seated wholly within one arm of the first tubular structure, the spring means having its inner end seated against the inner end of said one arm of the tubular structure for arresting the movement of the spring, a pair of upstanding hinge plates secured adjacent to the free ends of each arm of the first tubular structure, a hinge plate secured adjacent the free ends of each arm of the third tubular structure, individual means for swingably securing each of said hinge plates for the third tubular structure for swinging movement between an individual pair of said hinge plates for the first tubular structure to permit the third tubular structure to be moved relative to the first tubular structure, the hinge plate for the third tubular structure secured adjacent said one arm of the first tubular structure mounting the spring means including a portion constructed and defined with a plurality of spaced apart locking detents for locking the third tubular structure in an upright position or one of a plurality of positions reclined therefrom and having a dependent portion constructed and defined in a spaced relationship with the outer most reclining locking detent, a spring operating means having one end coupled adjacent the free end of said dependent portion and the opposite end arranged within said one arm of the first tubular structure for seating the outer end of the spring means and to progressively extend into said one arm for compressing the spring as the third tubular structure is swung away from the upright locking detent to the progressively rearward reclining locking detents and to be progressively extended out of said one arm to release the compressed spring as the third tubular structure is swung from a preselected reclining locking detent towards the upright locking detent, a manually operable control arm pivotably secured to one of the hinge plates for the pair of hinge plates adjacent the spring means mounting arm of the first tubular structure and carrying a latching finger movable between said pair of hinge plates for locking engagement with a locking detent, the locking finger is pivotally controlled by the manual operation of the control arm by an individual seated on the upholstered seating structure by the individual swinging the control arm out of locking engagement with one locking detent and into locking engagement with another locking detent to position the back supporting structure in a desired upright or reclined position while releasing the pressure exerted by the sitter, while sitting, against the back supporting structure or while applying additional pressure against the back supporting structure, while sitting, to swing the back supporting structure to the desired reclined position, and means for biasing the control arm in an operative relationship.

2. A frame for a seating structure adapted to be moved from an upright to a plurality of reclinable positions as defined in claim 1 wherein said compression spring means is a single compression spring and the spring operating means comprises a single rod having a disc-like element secured adjacent one end for seating the outer end of the spring and the other end of the rod being bent in a hook-like configuration for securing it to said free end of said dependent portion.

3. A frame for a seating structure adapted to be moved from an upright to a plurality of reclinable positions as defined in claim 1 wherein each of said tubular structures is constructed and defined of heavy duty wall tubing meeting federal safety regulations for motor vehicles and the tubing is secured by welding.

4. A frame for a seating structure adapted to be moved from an upright to a plurality of reclinable positions as defined in claim 3 wherein said compression spring means is a single compression spring and the spring operating means comprises a single rod having a disc-like element secured adjacent one end for seating the outer end of the spring and the other end of the rod being bent in a hook-like configuration for securing it to said free end of said dependent portion.

5. A frame for a seating structure adapted to be moved from an upright to a plurality of reclinable positions as defined in claims 1 or 3 wherein the pivotal securement of the manually operable control arm comprises fastening means extending between said pair of hinge plates adjacent the spring means mounting arm of the first tubular structure, and the means for biasing the control arm comprises a spring wire element having one end bent and secured to the open end of said one arm of the tubular structure mounting the spring means and being wrapped around said fastening means with the remaining end biasing the end of said control arm in an operative relationship.

* * * * *